US007348582B2

(12) United States Patent
Hasegawa

(10) Patent No.: US 7,348,582 B2
(45) Date of Patent: Mar. 25, 2008

(54) LIGHT SOURCE APPARATUS AND EXPOSURE APPARATUS HAVING THE SAME

(75) Inventor: Takayuki Hasegawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 11/109,078

(22) Filed: Apr. 18, 2005

(65) Prior Publication Data

US 2006/0192156 A1 Aug. 31, 2006

(30) Foreign Application Priority Data

Apr. 19, 2004 (JP) ..... 2004-123502

(51) Int. Cl.
*H05H 1/00* (2006.01)
*H05H 1/24* (2006.01)

(52) U.S. Cl. ..... 250/504 R; 250/492.1; 250/493.1

(58) Field of Classification Search ..... 250/504, 250/225, 504 R, 492.1, 493.1; 272/75; 356/458
See application file for complete search history.

(56) References Cited

U.S. PATENT DOCUMENTS

| | | | | |
|---|---|---|---|---|
| 7,068,367 | B2 * | 6/2006 | Stobrawa et al. | 356/318 |
| 7,091,507 | B2 * | 8/2006 | Masaki et al. | 250/504 R |
| 2005/0178979 | A1 * | 8/2005 | Masaki et al. | 250/492.1 |
| 2005/0205811 | A1 * | 9/2005 | Partlo et al. | 250/504 R |
| 2006/0011870 | A1 * | 1/2006 | Yamamoto et al. | 250/504 R |

FOREIGN PATENT DOCUMENTS

| | | |
|---|---|---|
| JP | 2000-56099 | 2/2000 |

* cited by examiner

*Primary Examiner*—Robert Kim
*Assistant Examiner*—Johnnie L Smith, II
(74) *Attorney, Agent, or Firm*—Morgan & Finnegan, L.L.P.

(57) ABSTRACT

A light source apparatus for irradiating a laser light onto a target, for generating plasma, and for producing light from the plasma, said light source apparatus includes a first detection part for detecting a position of the target, an adjusting part for adjusting a position of a condenser point of the laser light, and a first controller for controlling the adjusting part so that the position of the target detected by the first detection part is corresponding to the condenser point of the laser light.

18 Claims, 12 Drawing Sheets

1

LIGHT SOURCE APPARATUS AND EXPOSURE APPARATUS HAVING THE SAME

BACKGROUND OF THE INVENTION

The present invention relates generally to a light source apparatus, and more particularly to a light source used in an exposure apparatus for fabricating various devices including semiconductor chips such as ICs and LSIs, display devices such as liquid crystal panels, sensing devices such as magnetic heads, and image pick-up devices such as CCDs, as well as fine patterns used for micromechanics. The present invention is suitable for an exposure apparatus that uses X-ray and/or extreme ultraviolet ("EUV") light as a light source for exposure.

Conventionally, during manufacturing, photolithography technology, a reduction projection exposure apparatus using a projection optical system to project a circuit pattern formed on a reticle (mask) onto a wafer, etc., has been employed for transferring the circuit pattern of fine semiconductor devices such as semiconductor memory and logic circuit.

The minimum critical dimension transferred by the projection exposure apparatus or resolution is proportional to the wavelength of light used for exposure and inversely proportional to the numerical aperture ("NA") of the projection optical system. The shorter the wavelength is, the better the resolution. Thus, along with recent demands for finer semiconductor devices, shorter ultraviolet light wavelengths have been proposed—from an ultra-high pressure mercury lamp (I-line with a wavelength of approximately 365 nm) to KrF excimer laser (with a wavelength of approximately 248 nm) and ArF excimer laser (with a wavelength of approximately 193 nm).

However, lithography using ultraviolet light has limitations when it comes to satisfying the rapidly promoted fine processing of a semiconductor device. Therefore, a reduction projection optical system using extreme ultraviolet ("EUV") light with a wavelength of 10 to 15 nm shorter than that of the ultraviolet (referred to as an "EUV exposure apparatus" hereinafter) has been developed to efficiently transfer very fine circuit patterns of 100 nm or less.

The EUV light source uses, for example, a laser plasma light source that irradiates a high-intensity pulse laser light onto a target material, such as a metal thin coating, inert gases and liquid drops, in the vacuum chamber, generates the high-temperature plasma, and uses the EUV light having a wavelength of, for example, about 13 nm.

Such EUV light source attracted people's attentions as the light source in the semiconductor fabricating as above-mentioned, and generally is not adjusted (for example, a positional correction of condenser point of EUV light etc.) in the EUV exposure apparatus after the alignment of an optical element ends. Maintaining a constant generation position of EUV light at the predetermined position have been proposed as the adjustment of the EUV light source (see, for example, Japanese Patent Application Publication No. 2000-56099). The proposal detects EUV light generated from a plasma by a pin hole camera and a CCD, and controls the generation position of EUV light by controlling a supply position of the target or a irradiation position of the pulse laser (a condenser point position of the pulse laser).

However, in prior art, because only the generation position of plasma has been detected, an actual target position is not known. Therefore, even if the condenser point position of the pulsed laser changes on the target, it is not possible to detect it. As a result, a temperature and shape etc. of plasma change, and deterioration of the exposure performance is caused by changing light intensity and light intensity distribution of EUV light used for the exposure.

The condenser point position of generated EUV light changes, as a result, because of a changing position relationship of the condenser point position of the pulse laser and the supply position of the target, and the light intensity and light intensity distribution of EUV light change similarly.

BRIEF SUMMARY OF THE INVENTION

Accordingly, it is an exemplary object of the present invention to provide a light source apparatus and exposure apparatus having the same that irradiates a laser to a best position for a target, and maintains a condenser point position of generated light to a predetermined position, and enables an exposure apparatus that has an excellent exposure performance to be achieved.

A light source apparatus according to one aspect of the present invention for irradiating a laser light onto a target, for generating plasma, and for producing light from the plasma, said light source apparatus includes a first detection part for detecting a position of the target, an adjusting part for adjusting a position of a condenser point of the laser light, and a first controller for controlling the adjusting part so that the position of the target detected by the first detection part is corresponding to the condenser point of the laser light.

A light source apparatus according to another aspect of the present invention for irradiating a laser light onto a target, for generating plasma, and for producing light from the plasma, said light source apparatus includes a part for controlling a position of a condenser point of the laser light that the condenser point of the laser light is irradiated to a predetermined position when a position of the target changes.

A light source apparatus according to another aspect of the present invention for irradiating a laser light onto a target, for generating plasma, and for producing light from the plasma, said light source apparatus includes a part for controlling at least one of a position, posture, and form of a condenser mirror that condenses the light so that a condenser point of the light does not change when a generation position of the light changes by a positional change of the target.

A light generator method according to still another aspect of the present invention for irradiating a laser light onto a target, for generating plasma, and for producing light from the plasma, includes the steps of obtaining a position of the target, calculating a driving amount of an optical system that adjusts a condenser point of the light so that the laser light condenses at the position of the target obtained in the obtaining step, and driving the optical system according to the driving amount calculated in the calculating step.

A light generator method according to still another aspect of the present invention for irradiating a laser light onto a target, for generating plasma, and for producing light from the plasma, includes the steps of obtaining a position of the target, first calculating step for calculating a position of the plasma from the position of the target obtained in the obtaining step, second calculating step for calculating a driving amount of a condenser mirror that changes a position of a condenser point of the laser light so that the condenser point of the laser light is a predetermined position based on the position of the plasma calculated in the first calculating step, and driving the condenser mirror according to the driving amount calculated in the second calculating step.

An exposure apparatus according to another aspect of the present invention for exposing a pattern of a reticle onto an object, said exposure apparatus includes a light source apparatus, and an optical system for illuminating the reticle using light taken by said light source apparatus, wherein said light source apparatus for irradiating a laser light onto a target, for generating plasma, and for producing light from the plasma, said light source apparatus includes, a detection part for detecting a position of the target, an adjusting part for adjusting a position of a condenser point of the laser light, and a controller for controlling the adjusting part so that the position of the target detected by the first detection part is corresponding to the condenser point of the laser light.

An exposure apparatus according to another aspect of the present invention for exposing a pattern of a reticle onto an object, said exposure apparatus includes a light source apparatus, and an optical system for illuminating the reticle using light taken by said light source apparatus, wherein said light source apparatus for irradiating a laser light onto a target, for generating plasma, and for producing light from the plasma, said light source apparatus includes, a part for controlling a position of a condenser point of the laser light that the condenser point of the laser light is irradiated to a predetermined position when a position of the target changes.

An exposure apparatus according to another aspect of the present invention for exposing a pattern of a reticle onto an object, said exposure apparatus includes a light source apparatus, and an optical system for illuminating the reticle using light taken by said light source apparatus, wherein said light source apparatus for irradiating a laser light onto a target, for generating plasma, and for producing light from the plasma, said light source apparatus includes, a part for controlling at least one of a position, posture, and form of a condenser mirror that condenses the light so that a condenser point of the light does not change when a generation position of the light changes by a positional change of the target.

A device fabrication method according to another aspect of the present invention includes the steps of exposing an object using an exposure apparatus, and performing a development process for the object exposed, wherein said exposure apparatus for exposing a pattern of a reticle onto the object, said exposure apparatus includes, a light source apparatus, and an optical system for illuminating the reticle using light taken by said light source apparatus, wherein said light source apparatus is for irradiating a laser light onto a target, for generating plasma, and for producing light from the plasma, said light source apparatus includes, a detection part for detecting a position of the target, an adjusting part for adjusting a position of a condenser point of the laser light, and a controller for controlling the adjusting part so that the position of the target detected by the first detection part is corresponding to the condenser point of the laser light.

A device fabrication method according to another aspect of the present invention includes the steps of exposing an object using an exposure apparatus, and performing a development process for the object exposed, wherein said exposure apparatus for exposing a pattern of a reticle onto the object, said exposure apparatus includes, a light source apparatus, and an optical system for illuminating the reticle using light taken by said light source apparatus, wherein said light source apparatus is for irradiating a laser light onto a target, for generating plasma, and for producing light from the plasma, said light source apparatus includes, a part for controlling a position of a condenser point of the laser light that the condenser point of the laser light is irradiated to a predetermined position when a position of the target changes.

A device fabrication method according to another aspect of the present invention includes the steps of exposing an object using an exposure apparatus, and performing a development process for the object exposed, wherein said exposure apparatus for exposing a pattern of a reticle onto the object, said exposure apparatus includes, a light source apparatus, and an optical system for illuminating the reticle using light taken by said light source apparatus, wherein said light source apparatus is for irradiating a laser light onto a target, for generating plasma, and for producing light from the plasma, said light source apparatus includes, a part for controlling at least one of a position, posture, and form of a condenser mirror that condenses the light so that a condenser point of the light does not change when a generation position of the light changes by a positional change of the target.

A measuring apparatus according to another aspect of the present invention for measuring a reflectivity of an object to be measured, said measuring apparatus includes a light source apparatus, a irradiating part for irradiating the light taken by said light source apparatus to the object to be measured, and a detector part for detecting the light reflected from the object to be measured, wherein said light source apparatus for irradiating a laser light onto a target, for generating plasma, and for producing light from the plasma, said light source apparatus includes, a detection part for detecting a position of the target, an adjusting part for adjusting a position of a condenser point of the laser light, and a controller for controlling the adjusting part so that the position of the target detected by the first detection part is corresponding to the condenser point of the laser light.

Other objects and further features of the present invention will become readily apparent from the following description of the preferred embodiments with reference to the accompanying drawings.

DETAILED DESCRIPTION OF THE PREFERRED EMBODIMENTS

Figure 1:
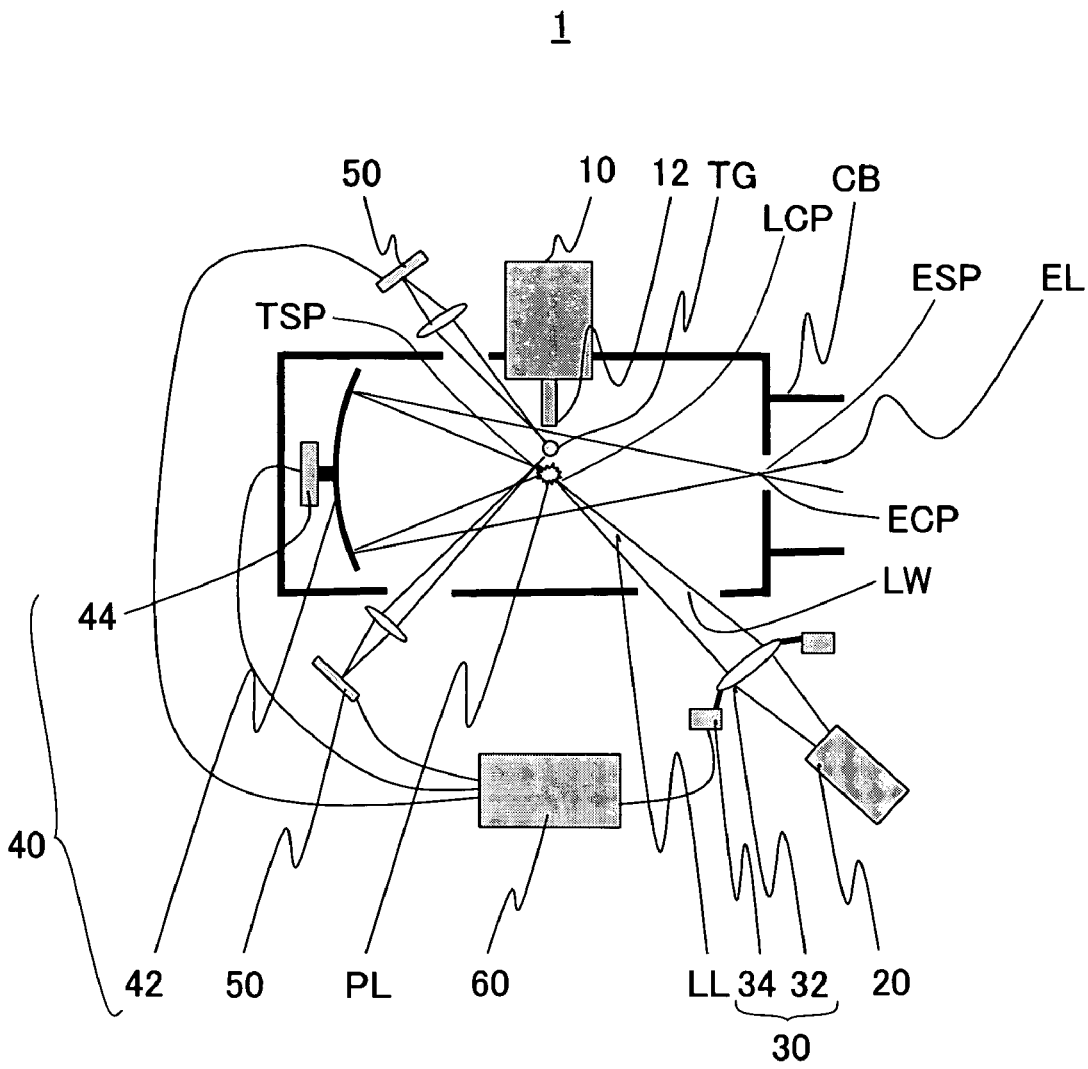
FIG. 1 is a schematic sectional view of a light source apparatus as one aspect according to the present invention.

With reference to the accompanying drawings, a description will be given of a light source apparatus 1 of one embodiment according to the present invention. In each figure, the same reference numeral denotes the same element. Therefore, duplicate descriptions will be omitted. FIG. 1 is a schematic sectional view of the light source apparatus 1.

The light source apparatus 1 is one that irradiates a laser light LL onto a target TG, generates a plasma PL, and producing the EUV light EL from the plasma PL. The light source apparatus 1 includes, as shown in FIG. 1, a target supply apparatus 10, a laser light source part 20, a adjusting part 30, a changing part 40, a target detection part 50, and a controller 60.

The target supply apparatus 10 supplies the target TG to a predetermined position TSP in a chamber CB maintained to the vacuum or reduced pressure atmosphere through a target emitting part 12. The target supply apparatus 10 supplies the target TG in synchronization with emissions of the laser light LL of the laser light source part 20 described later. The target TG is liquid drops in this embodiment, but may be solid of metal (such as copper, tin, and aluminum), Xe gases, or clusters.

The laser light source part. 20 emits the laser light LL aiming at the target TG, and generates the plasma PL. The laser light LL is the pulse laser in this embodiment. The pulse laser preferably has high repetitive frequency, e.g., usually several kHz, for increased average intensity of the emitted EUV light EL from the target TG (plasma PL).

The adjusting part 30 adjusts the position of a condenser point LCP of the laser light LL emitted from the laser light source part 20. The adjusting part 30 includes a laser optical system 32 and a driving mechanism 34.

The optical system 32 includes a lens, a mirror, a plane-parallel glass plate, etc., and introduce the emitted laser light LL from the laser light source part 20 to the chamber CB through a laser introducing window LW. The laser introducing window LW is used for a part of a diaphragm of the chamber CB, and consists of a material that transmits the laser light LL. In order to efficiently take out the EUV light EL, the laser optical system 32 serves to adjust a spot size and energy density of the laser light LL necessary and enough to generate the plasma PL from the target TG. In other words, the laser optical system 32 form the condenser point LCP of the laser light LL.

The driving mechanism 34 drives the laser optical system 32. Concretely, the driving mechanism 34 drives the lens that composes the laser optical system 32 in a parallel direction for an optical axis of the laser light LL, and tilts the plane-parallel glass plate that composes the laser optical system 32 for the optical axis of the laser light LL. Thereby, the condenser point position of the laser light LL can be adjusted.

The changing part 40 changes a position of condenser point ECP of the EUV light EL emitted from the plasma PL. The changing part 40 includes a condenser mirror 42 and a driving mechanism 44. The plasma PL is very high-temperature, for instance, generates the suitable EUV light EL for the exposure.

The condenser mirror 42 condenses the EUV light EL emitted from the plasma PL. In other words, the condenser mirror 42 condenses the EUV light EL from the plasma PL, and forms the condenser point ECP. The condenser mirror 42 supplies the EUV light EL to an optical system (for example, an illumination optical system etc. in case of an exposure apparatus).

The condenser mirror 42 is, for example, a multilayer mirror of spheroid form that installs a multilayer film that has an effect to enhance the reflection light at the reflection surface. It is conceivable that a multilayer film that may reflect the EUV light having a wavelength of less than 20 nm includes, for example, a molybdenum (Mo)/silicon (Si) multilayer film that alternately laminates Mo and Si layers or a molybdenum (Mo)/beryllium (Be) multilayer film that alternately laminates Mo and Be layers. To decrease the surface roughness at the interface of the multilayer film, boron carbide ($B_4C$) may be formed as a buffer layer between molybdenum (Mo) layer and silicon (Si) layer.

The driving mechanism 44 drives a position and posture of the condenser mirror 42. The driving mechanism 44 drives the position and posture of the condenser mirror 42, and a focus position of the condenser mirror 42 changes. As a result, the position of the condenser point ECP of the EUV light EL changes. The driving mechanism 44 may serve to change the shape of the condenser mirror 42 (in other words, a curvature and focus position). For example, the condenser mirror is composed of a plural board members, the driving mechanism 44 drives the board members, and the shape of the condenser mirror 42 is changed. The condenser mirror 42 of plural different shape is arranged in a turret, the driving mechanism 44 drives the turret, and the condenser mirror 42 can be exchanged.

The target detection part 50 detects a position of the target TG supplied from the target supply apparatus 10. The target TG is set to be supplied to a predetermined position TSP, but actually, might shift from the predetermined position TSP by an environmental change etc. Then, the target detection part 50 is installed to detect the supply position of the target TG. In other words, the target detection part 50 can detect a shift between the predetermined position TSP and the supply position of the target TG.

The target detection part 50 irradiates light to the target TG, images the image of reflection light from the target TG onto the sensor surface, and detects the position of the target TG by the change of the position. However, the target detection part 50 of the present invention does not limit the above structure, and may apply to any structure that can detect the position of the target TG.

The controller 60 includes a CPU and memory (not shown) and controls operation of the exposure apparatus 1. The controller 60 is electrically connected to the driving mechanism 34, the driving mechanism 44, and the target detection part 50. The controller 60 controls, in instant embodiment, the adjusting part 30 based on the detection result from the target detection part 50. In other words, the controller 60 controls the position of the condenser position LCP of the laser light LL through the driving mechanism 34 so that the position of the target TG detected by the target detection part 50 and the condenser point LCP of the laser light LL are corresponding. Moreover, the controller 60 controls the changing part 40 so that the condenser point ECP may be a predetermined position ESP, because the position of the condenser point LCP of the EUV light EL may change according to the supply position of the target TG (the generation position of the plasma PL changes) when the target TG is supplied at a position that shifts from the predetermined position TSP.

A description will be given of a control that the position of the target TG and the condenser point LCP of the laser light LL are corresponding. First, the position of the target TG supplied from the target supply apparatus 10 is detected by the target detection part 50. The controller 60 drives the laser optical system 20 through the driving mechanism 34 based on the position of the target TG detected by the target detection part 50,and adjusts the condenser position LCP of the laser light LL as corresponding to the position of the target TG.

Figure 2B:
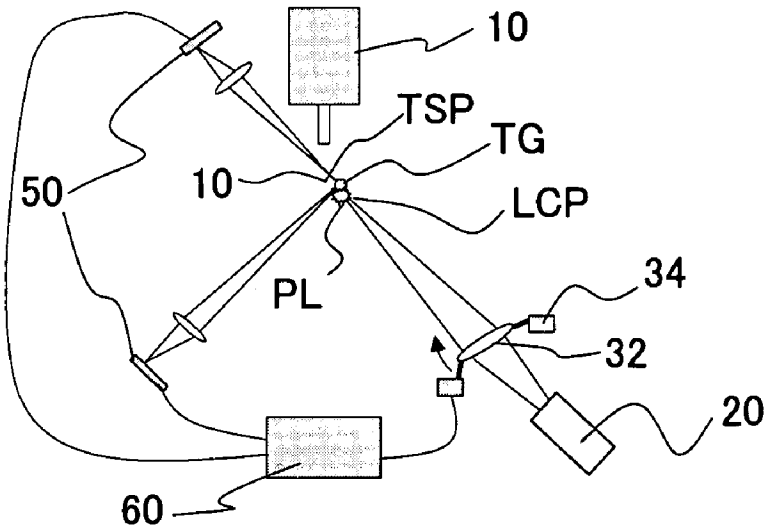
FIGS. 2A and 2B are views for explaining a control of a condenser point of laser light in the light source apparatus shown in FIG. 1.
Figure 2A:
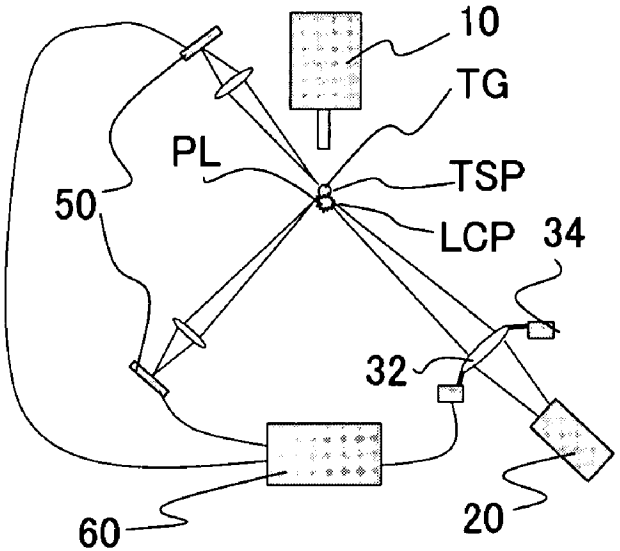

FIGS. 2A and 2B are views for explaining the control of the condenser point LCP of laser light LL. FIG. 2A shows only a significance part (the target supply apparatus 10, the laser light source 20, the adjusting part 30, the target detection part 50, and the controller 60) related to the control of the condenser point LCP of laser light LL.

In FIG. 2A, the target TG is supplied to the predetermined position TSP through the target supply apparatus 10, and the laser light LL is condensed at the predetermined position TSP where the target TG is supplied. However, the target TG might not be supplied to the predetermined position TSP (in other words, the supply position of the target TG and the predetermined position TSP shift). For this case, if the laser light LL is irradiated to the predetermined position TSP as the state shown in FIG. 2B, the light intensity and shape of the generated EUV light EL etc. change because the position at which the laser light LL is irradiated on the target TG changes.

Then, the controller 60 calculates a driving amount of the laser optical system 32 based on the position of the target TG detected by the target detection part 50. Here, the calculated driving amount is a driving amount of the laser optical system 32 that is necessary so that the laser light LL may condense at the position of the target TG detected by the target detection part 50. The driving mechanism 34 drives the laser optical system 32 according to the driving amount calculated by the controller 60, changes the position and posture of the laser optical system 32, and the laser light LL is condensed to the supply position of the target TG.

As the instant embodiment, when the method to supply the target TG as liquid drops is used for the light source of the exposure apparatus, the frequency of the emission of the laser light source part 20 is several kHz. Thereby, a low-pass filter etc. are inserted to the detection result of the target detection part 50, and the condenser point of the laser light may be controlled for a positional change of the target TG below a predetermined frequency.

Figure 3A:
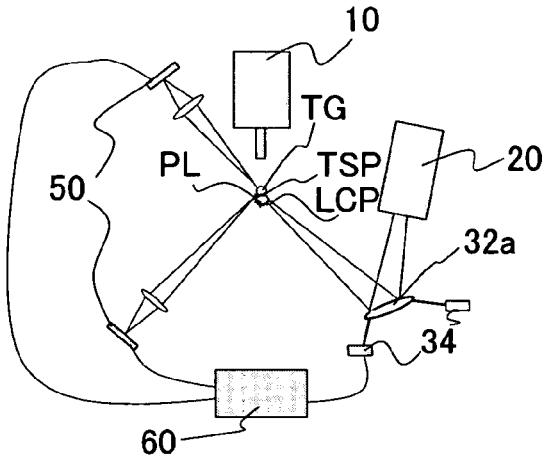
FIGS. 3A and 3B are views for explaining a control of a condenser point of laser light in the light source apparatus shown in FIG. 1.
Figure 3B:
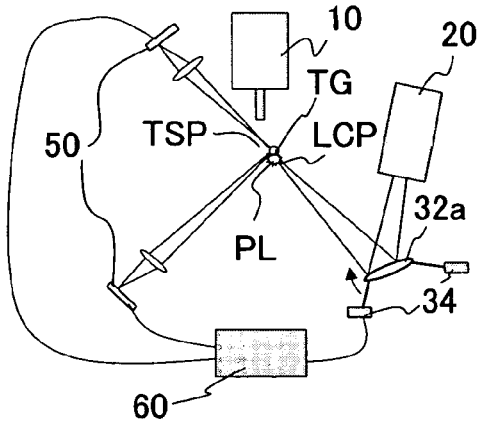

Moreover, as shown in FIGS. 3A and 3B, a plane mirror 32*a* is arranged in an optical path of the laser optical system 32, and the position of the condenser point LCP of the laser light LL may be controlled by changing the position and angle of the plane mirror 32*a*. Here, FIGS. 3A and 3B are views for explaining the control of the condenser point LCP of laser light LL. In FIG. 3A, the target TG is supplied to the predetermined position TSP through the target supply apparatus 10, and the laser light LL is condensed at the predetermined position TSP that the target TG is supplied. In FIG. 3B, the plane mirror 32*a* is driven according to the driving amount calculated by the controller 60, the position and angle of the plane mirror 32*a* are changed, and it controls so that the laser light LL may condense to the position of the target TG that supplies to the position that shifts from the predetermined position TSP.

However, if the position of condenser point LCP of the laser light LL can be controlled excluding the above structure, a similar effect is achieved. The instant embodiment emits the target TG from the target emitting part 12 as a supplying method of the target TG, however, the supplying method excluding this (for example, target of solid and target of tape form) can be applied to the present invention.

Figure 4B:
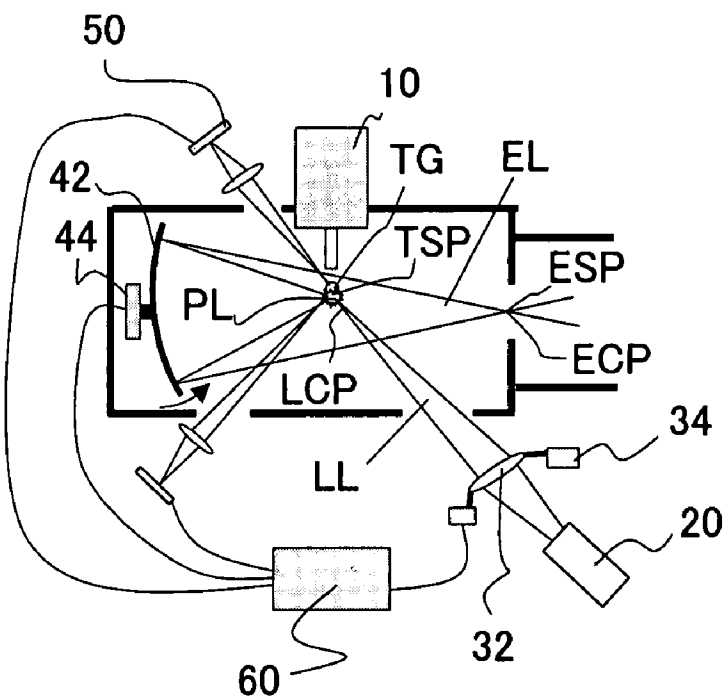
FIGS. 4A and 4B are views for explaining a correction of a condenser point position of EUV light in the light source apparatus shown in FIG. 1.
Figure 4A:
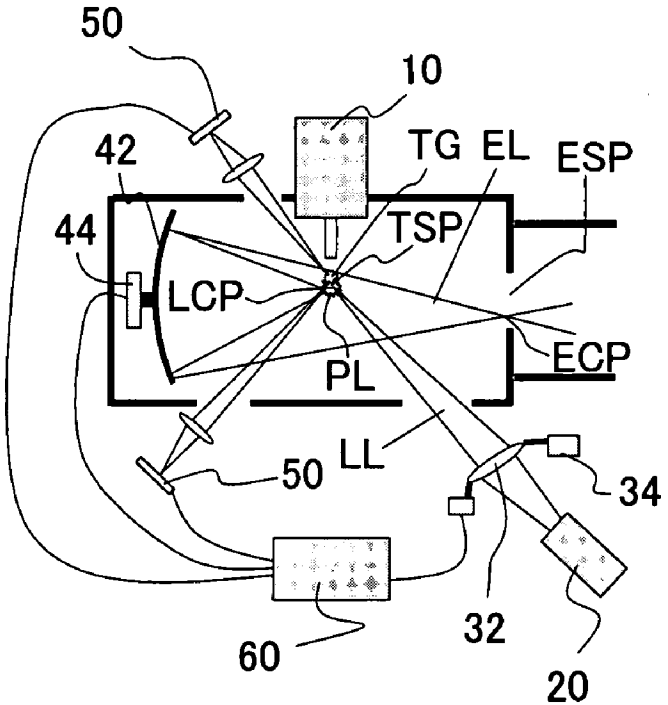

FIGS. 4A and 4B are views for explaining a correction of the condenser point ECP of the EUV light EL. As above-mentioned, when the condenser point LCP of the laser light LL according the supply position of the target TG, the generation position of the plasma PL changes according it, as shown in FIG. 4A, the condenser point ECP of the EUV light EL shifts from the predetermined position ESP. Then, the position and posture of the condenser mirror 42 is changed through the driving mechanism 44 controlled by the controller 60, and the shift between the condenser point ECP of the EUV light EL and predetermined position ESP is corrected as shown in FIG. 4B.

Concretely, the controller 60 calculates an emission position of the EUV light EL, in other words, the generation position of the plasma PL based on the detection result of the target detection part 50. As above-mentioned, the laser light LL is controlled to always condense to the target TG (in other words, the condenser point LCP exists on the target TG), and the emission position of the EUV light EL can be calculated by detecting the position of the target TG.

The controller 60 calculates the driving amount of the condenser mirror 42 necessary to corresponding the position of the condenser point ECP to the predetermined position ESP by the change of calculated the emission position of the EUV light EL, and controls the position and posture of the condenser mirror 42 through the driving mechanism 44. The relationship between the emission point of the EUV light EL and the position of the condenser point ECP measures the position relationship among the emission point, the condenser mirror 44, and the condenser point ECP beforehand, and calculates the driving amount of the condenser mirror 44 based on the measurement result.

As above-explained, the light source apparatus 1 always irradiates the laser light LL to a constant position for the target TG (the laser light LL always condenses the target TG), and can control the condenser point ECP of the generated EUV light EL within a prescribed range. Therefore, the light source apparatus 1 can generate the EUV light EL of a steady position and light intensity.

Figure 5:
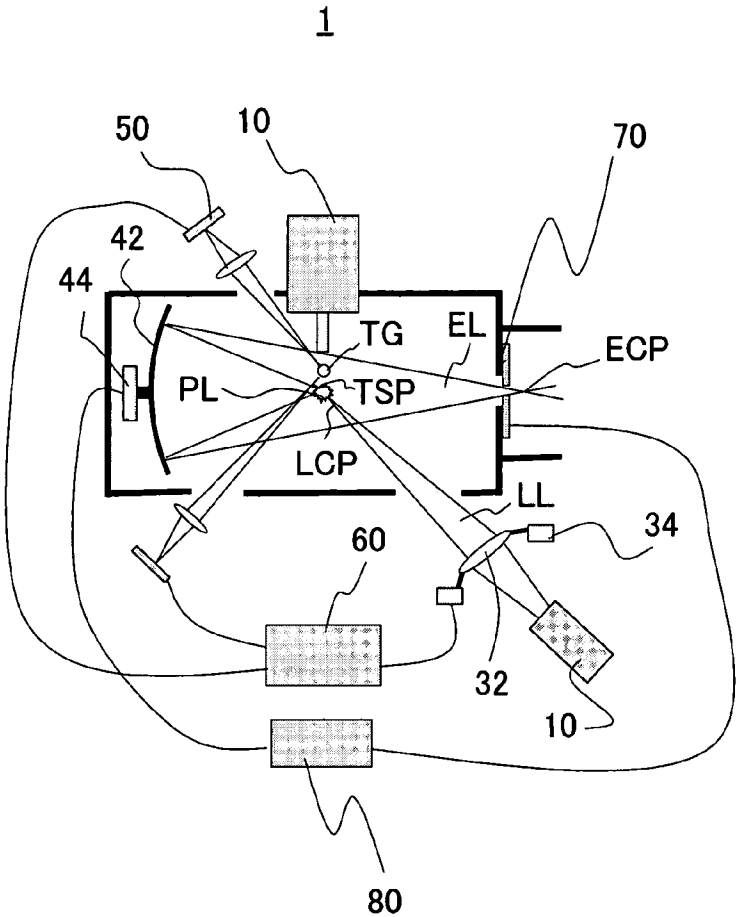
FIG. 5 is a schematic sectional view of a light source apparatus as one aspect according to the present invention.

A condenser point detection part 70 that detects the position of the condenser point ECP of the EUV light EL is installed in the neighborhood of the condenser point ECP of the EUV light EL as shown in FIG. 5, and the position of the condenser point ECP of the EUV light EL may be corrected based on the detection result of the condenser point detection part 70. In the instant embodiment, a controller 80 that calculates the driving amount of the condenser mirror 42 from the position of the condenser point ECP of the EUV light EL detected by the condenser point detection part 70 is installed, but the controller 60 may have the function of the controller 80. Here, FIG. 5 is a schematic sectional view of the light source apparatus 1 that has the condenser point detection part 70.

The condenser point detection part 70 is made an embodiment as a four-division sensor 70A that detects the position of the condenser point ECP of the EUV light EL and has a pinhole 72. The four-division sensor 70A has four sensors 74*a*, 74*b*, 74*c*, and 74*d* that detect the light intensity of the EUV light EL, and has the pinhole 72 at the center.

Figure 6:
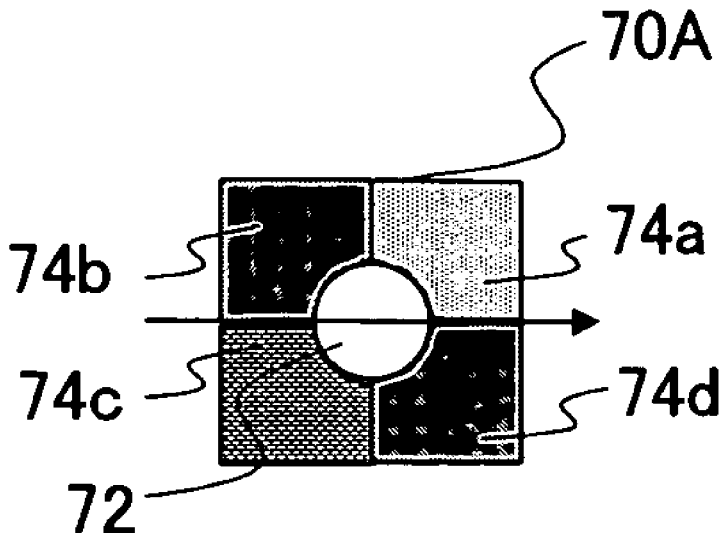
FIG. 6 is a plane view of a four-division sensor as a one example of a condenser point detection part shown in FIG. 5.

The pinhole 72 arranged at the center of the four-division sensor 70A is formed, for example, with the size in which the EUV light EL enough for the exposure is passed and the size where the change of the position of the condenser point ECP of the EUV light EL can be detected. For example, when the condenser point ECP is an intensity distribution that has Gauss distribution shape, if a diameter of the pinhole 72 is about 6 s (s is an amount that expresses an extension of Gauss distribution), the position of the condenser point ECP can be detected without giving the influence to the transmittance quantities of the EUV light EL. Here, FIG. 6 is a plane view of the four-division sensor 70A as a one example of the condenser point detection part 70.

Figure 7:
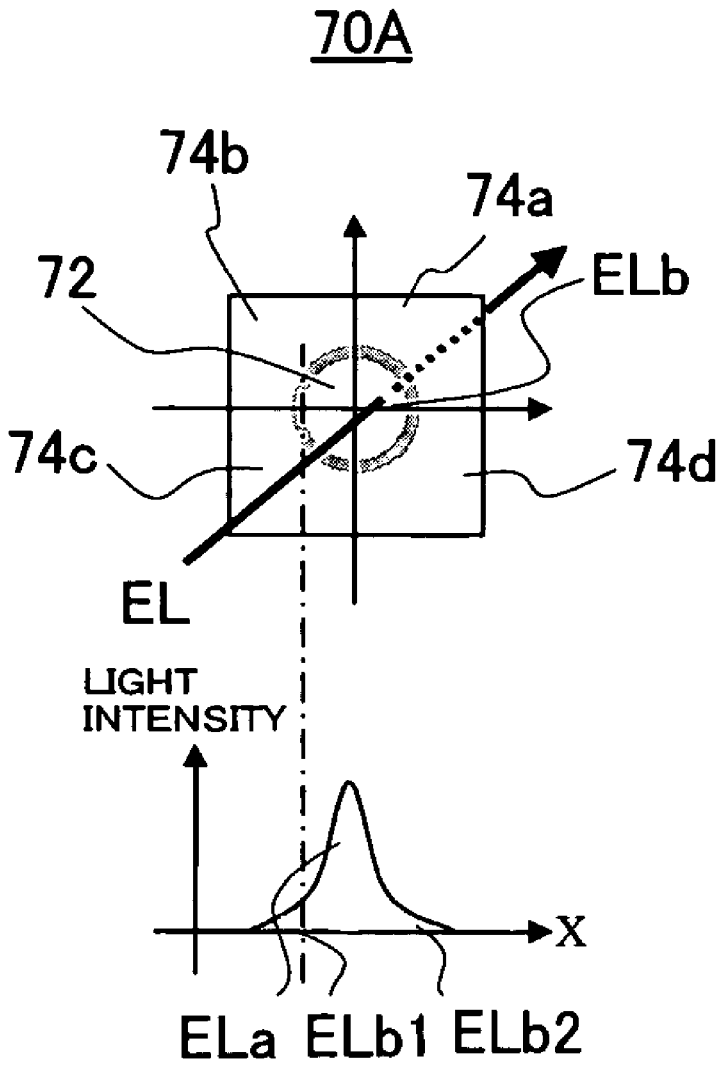
FIG. 7 is a view of a position relationship of (a pin hole of) the four-division sensor and EUV light, and a light intensity of EUV light detected at the four-division sensor.
Figure 8:
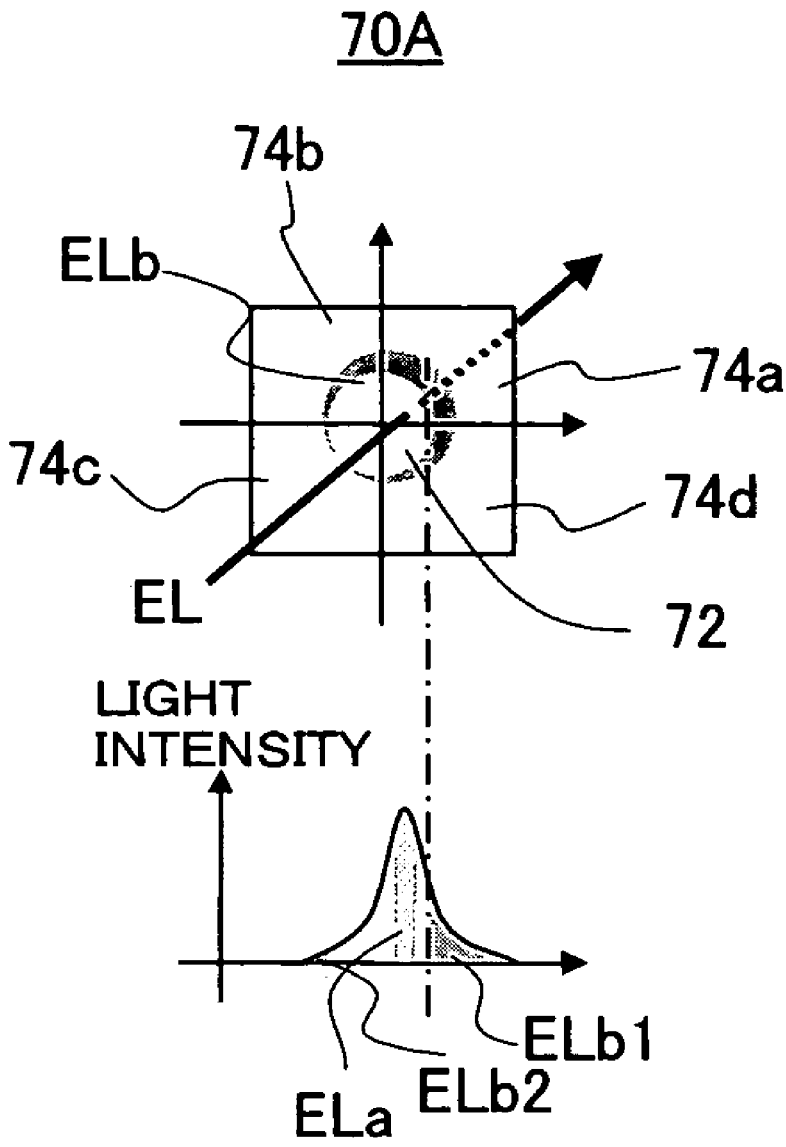
FIG. 8 is a view of a position relationship of (a pin hole of) the four-division sensor and EUV light, and a light intensity of EUV light detected at the four-division sensor.

FIGS. 7 and 8 is a view of a position relationship of (the pinhole 72 of) the four-division sensor 70A and the EUV light EL, and a light intensity of EUV light EL detected at the four-division sensor 70A. In FIGS. 7 and 8, ELa is a part of the EUV light EL, and is, for example, light used for the exposure, and ELb ($ELb_1$ and $ELb_2$) is not used for the exposure, but is light that is irradiated to the four-division sensor 70A, and used to detect the position of the condenser point ECP.

Referring to FIG. 7, the EUV light EL is irradiated to a center part of the pinhole 72 of the four-division sensor 70A. In this case, energy is evenly irradiated to the sensor 74*a* to 74*d* of the four-division sensor 70A. However, when the EUV light EL is not irradiated to the center part of the pinhole 72 of the four-division sensor 70A, the most a lot of energy is irradiated to the sensor 74*a* of the four-division sensor 70A. In this case, for example, the energy irradiated to the sensor 74*a* is assumed to be E74*a*, the energy irradiated to the sensor 74*b* is assumed to be E74*b*, the energy irradiated to the sensor 74*c* is assumed to be E74*c*, and the energy irradiated to the sensor 74*d* is assumed to be E74*d*, and if the relationship among the position of the EUV light EL (X, Y), $P=(E74a+E74b-E74c-E74d)/(E74a+E74b+E74c+E74d)$, and $Q=(E74a+E74d-E74b-E74c)/(E74a+E74b+E74c+E74d)$ is obtained by moving the four-division sensor 70A to the EUV light EL beforehand, the relationship between P=P(x, y) and Q=Q (x, y) can be obtained. Therefore, the position of the EUV light EL (X, Y) can be calculated according to the value of P and Q.

The controller 80 calculates the driving amount of the condenser mirror 42 from the position of the EUV light EL obtained as the above-mentioned. This drives the condenser mirror 42, and measures the position relationship between the position and posture of the condenser mirror 42 and the condenser point ECP beforehand.

The position of the condenser point ECP can be controlled in high-accuracy by installing the condenser point detection part 70 in the neighborhood of the condenser point ECP of the EUV light EL. The instant embodiment uses the four-division sensor 70A as the condenser point detection part 70, however, if a sensor that can detect the position of the condenser point ECP by using light that does not influence the exposure, and can achieve the similar effect.

The operation of the light source apparatus 1, the laser light LL emitted from the laser light source part 20 is condensed by the laser optical system 32, and is introduced from the laser introducing window LW in the chamber CB. The laser light LL introduced into the camber CB is irradiated to the target TG supplied from the target supply apparatus 10, and generates the plasma PL. The EUV light EL generated from the plasma PL is condensed by the condenser mirror 42, and is introduced to the optical system of latter part. As this time, the light source apparatus 1 can irradiate the laser light LL to the best position for the target TG by the adjusting part 30 and the changing part 40, and maintain the position of the condenser point ECP of the generated EUV light EL to the predetermined position. Therefore, for instance, the light source apparatus 1 can achieve the exposure apparatus that has an excellent exposure performance.

As mentioned above, the light source apparatus 1 always irradiates the laser light LL to the predetermined position for the target, and can achieve the EUV light source of steady light intensity. Moreover, if the emission position of the EUV light changes, the position of condenser point of the EUV light is always a prescribed range, and the light source apparatus 1 can supply steady EUV light, for instance, to the exposure apparatus etc.

Figure 9:
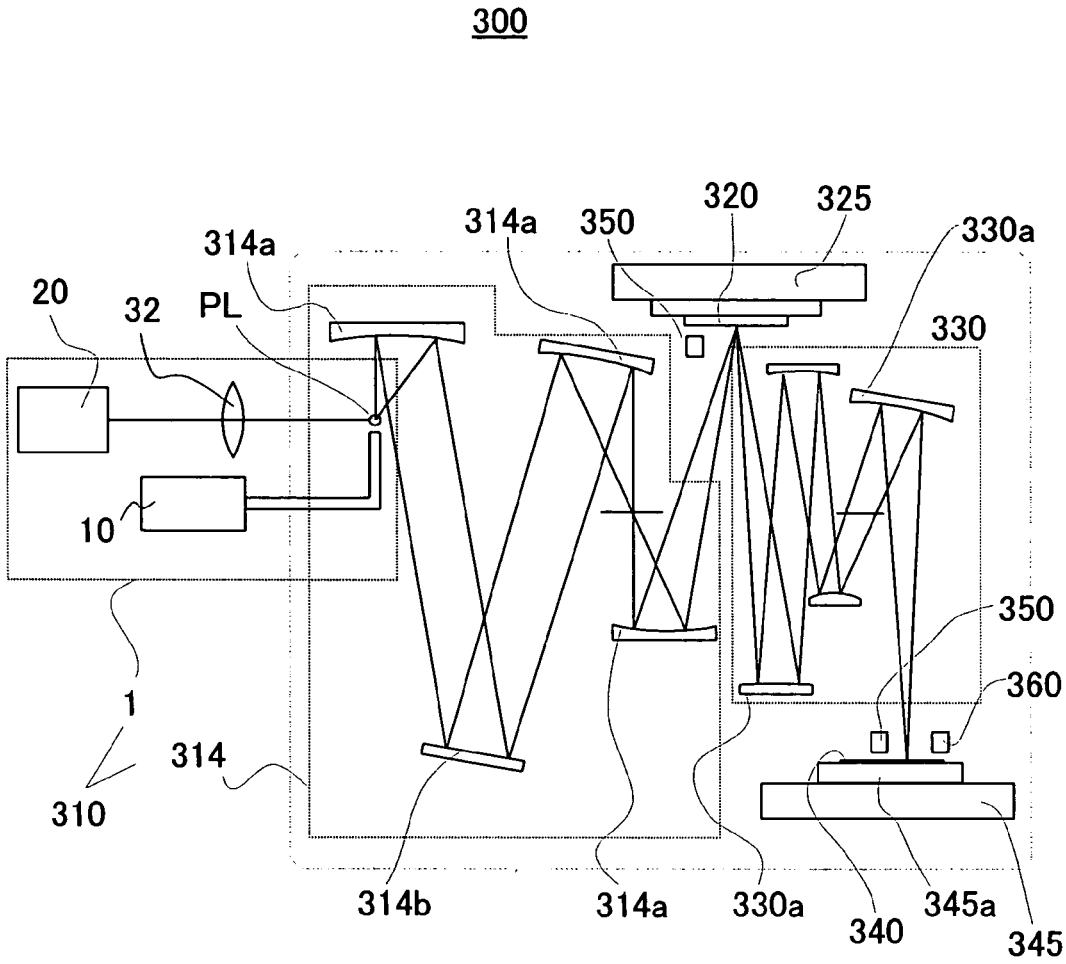
FIG. 9 is a schematic block diagram of an exposure apparatus as one aspect according to the present invention.

Referring to FIG. 9, a description will be given of an exemplary exposure apparatus 300 that applies the light source apparatus 1. Here, FIG. 9 is a schematic block diagram of the exposure apparatus 300 according to one aspect of the present invention.

The inventive exposure apparatus 300 uses the EUV light (with a wavelength of, e.g., 13.4 nm) as illumination light for exposure, and exposes onto an object 340 a circuit pattern of a reticle 320, for example, in a step-and-scan manner or step-and-repeat manner. This exposure apparatus is suitable for a lithography process less than submicron or quarter micron, and the present embodiment uses the step-and-scan exposure apparatus (also referred to as a "scanner") as an example. The "step-and-scan manner", as used herein, is an exposure method that exposes a reticle pattern onto a wafer by continuously scanning the wafer relative to the reticle, and by moving, after a shot of exposure, the wafer stepwise to the next exposure area to be shot. The "step-and-repeat manner" is another mode of exposure method that moves a wafer stepwise to an exposure area for the next shot every shot of cell projection onto the wafer.

Referring to FIG. 9, the exposure apparatus 300 includes an illumination apparatus 310, a reticle stage 325 mounted with the reticle 320, a projection optical system 330, a wafer stage 345 mounted with the object 340, an alignment detecting mechanism 350, and a focus position detecting mechanism 360.

The illumination apparatus 310 illuminates the reticle 320 using the EUV light that has a wavelength of, for example, 13.4 nm and an arc shape corresponding to an arc-shaped field of the projection optical system 330, and includes the light source apparatus 1 and an illumination optical system 314.

The light source apparatus 1 mat apply any of the above structures, and a detailed description thereof will be omitted.

The illumination optical system 314 includes a condenser mirror 314*a* and an optical integrator 314*b*. The condenser mirror 314*a* serves to collect EUV light that is irradiated approximately isotropically from the laser plasma, and the optical integrator 314*b* uniformly illuminates the reticle 320 with a predetermined aperture.

The reticle 320 is a reflection reticle, and has a circuit pattern (or image) to be transferred. The reticle 320 is supported and driven by the reticle stage 325. The diffracted light emitted from the reticle 320 is projected onto the object 340 after reflected by the projection optical system 330. The reticle 320 and the object 340 are arranged optically conjugate with each other. Since the exposure apparatus 300 is a scanner, the reticle 320 and object 340 are scanned to transfer a reduced size of a pattern of the reticle 320 onto the object 340.

The reticle stage 325 supports the reticle 320 and is connected to a moving mechanism (not shown). The reticle stage 325 may use any structure known in the art. The moving mechanism (not shown) may includes a linear motor etc., and drives the reticle stage 325 at least in a direction X and moves the reticle 320. The exposure apparatus 300 synchronously scans the reticle 320 and the object 340.

The projection optical system 330 uses plural multilayer mirrors 330*a* to project a reduce size of a pattern of the reticle 320 onto the object 340. The number of mirrors 330*a* is about four to six. For wide exposure area with the small number of mirrors, the reticle 320 and object 340 are simultaneously scanned to transfer a wide area that is an arc-shape area or ring field apart from the optical axis by a predetermined distance. The projection optical system 330 has a NA of about 0.2 to 0.3.

The instant embodiment uses a wafer as the object 340 to be exposed, but it may include a spherical semiconductor and liquid crystal plate and a wide range of other objects to be exposed. Photoresist is applied onto the object 340.

The object 340 to be exposed is held by the wafer stage 345 by a wafer chuck 345*a*. The wafer stage 345 moves the object 340, for example, using a linear motor in XYZ directions. The reticle 320 and the object 340 are synchronously scanned. The positions of the reticle stage 325 and wafer stage 345 are monitored, for example, by a laser interferometer, and driven at a constant speed ratio.

The alignment detecting mechanism 350 measures a positional relationship between the position of the reticle 320 and the optical axis of the projection optical system 330, and a positional relationship between the position of the object 340 and the optical axis of the projection optical system 330, and sets positions and angles of the reticle stage 325 and the wafer stage 345 so that a projected image of the reticle 320 may accord with the object 340.

The focus position detecting mechanism 360 measures a focus position on the object 340 surface, and controls over a position and angle of the wafer stage 345 always maintains the object 340 surface at an imaging position of the projection optical system 330 during exposure.

In exposure, the EUV light emitted from the illumination apparatus 310 illuminates the reticle 320, and images a pattern of the reticle 320 onto the object 340 surface. The instant embodiment uses an arc or ring shaped image plane, scans the reticle 320 and object 340 at a speed ratio corresponding to a reduction rate to expose the entire surface of the reticle 320. The light source apparatus 1 in the illumination apparatus 310 in the exposure apparatus 300 irradiates the laser light to the best position for the target, and can maintain the position of the condenser point of the generated EUV light to the predetermined position. Therefore, the exposure apparatus 300 achieves an excellent exposure performance, and provides devices (such as semiconductor devices, LCD devices, image pickup devices (e.g., CCDs), and thin film magnetic heads) with a high throughput and good economical efficiency.

Figure 10:
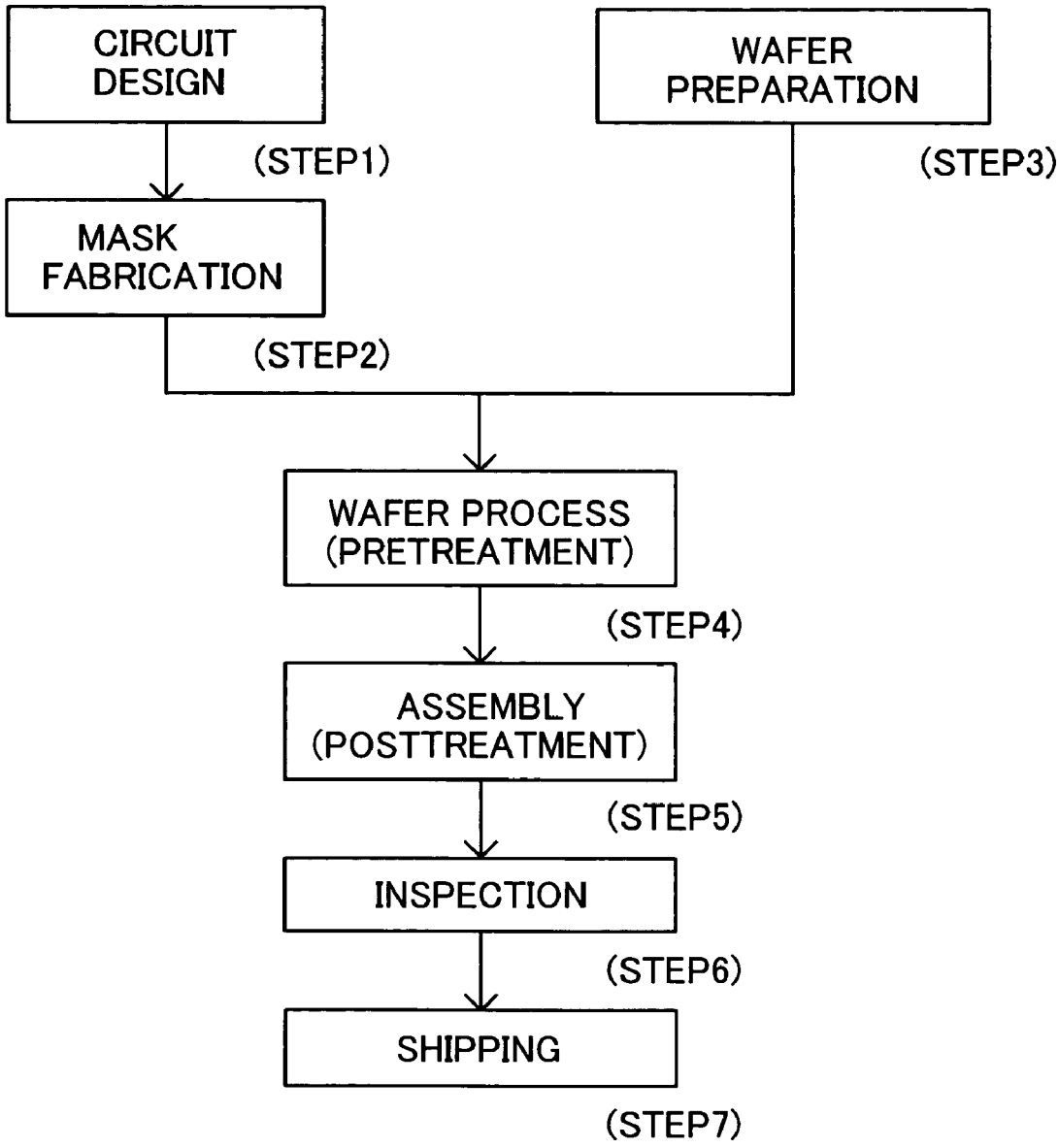
FIG. 10 is a flowchart for explaining how to fabricate devices (such as semiconductor chips such as ICs, LCDs, CCDs, and the like)
Figure 11:
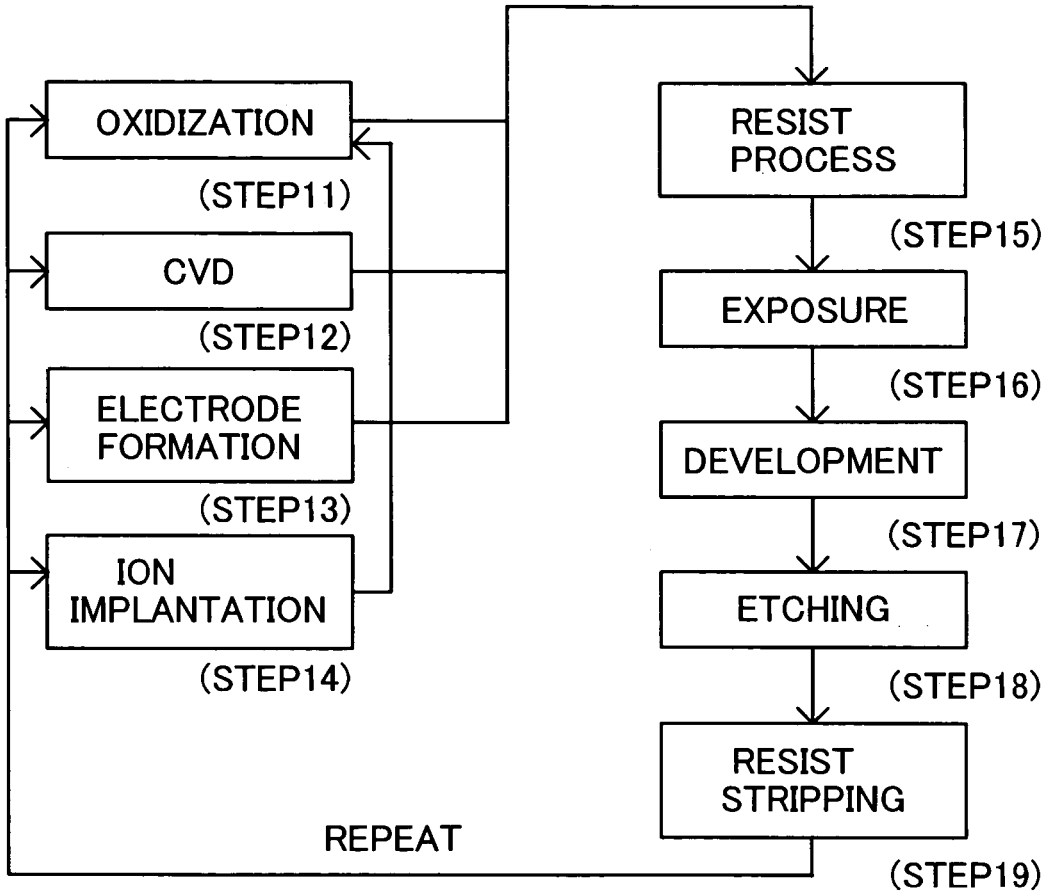
FIG. 11 is a detail flowchart of a wafer process in Step 4 of FIG. 10.

Referring now to FIGS. 10 and 11, a description will be given of an embodiment of a device fabrication method using the above mentioned exposure apparatus 1. FIG. 10 is a flowchart for explaining how to fabricate devices (i.e., semiconductor chips such as IC and LSI, LCDs, CCDs, and the like). Here, a description will be given of the fabrication of a semiconductor chip as an example. Step 1 (circuit design) designs a semiconductor device circuit. Step 2 (mask fabrication) forms a mask having a designed circuit pattern. Step 3 (wafer making) manufactures a wafer using materials such as silicon. Step 4 (wafer process), which is also referred to as a pretreatment, forms the actual circuitry on the wafer through lithography using the mask and wafer. Step 5 (assembly), which is also referred to as a post-treatment, forms into a semiconductor chip the wafer formed in Step 4 and includes an assembly step (e.g., dicing, bonding), a packaging step (chip sealing), and the like. Step 6 (inspection) performs various tests on the semiconductor device made in Step 5, such as a validity test and a durability test. Through these steps, a semiconductor device is finished and shipped (Step 7).

FIG. 11 is a detailed flowchart of the wafer process in Step 4. Step 11 (oxidation) oxidizes the wafer's surface. Step 12 (CVD) forms an insulating layer on the wafer's surface. Step 13 (electrode formation) forms electrodes on the wafer by vapor disposition and the like. Step 14 (ion implantation) implants ions into the wafer. Step 15 (resist process) applies a photosensitive material onto the wafer. Step 16 (exposure) uses the exposure apparatus 300 to expose a circuit pattern from the mask onto the wafer. Step 17 (development) develops the exposed wafer. Step 18 (etching) etches parts other than a developed resist image. Step 19 (resist stripping) removes unused resist after etching. These steps are repeated to form multi-layer circuit patterns on the wafer. The device fabrication method of this embodiment may manufacture higher quality devices than the conventional one. Thus, the device fabrication method using the exposure apparatus 1, and resultant devices constitute one aspect of the present invention.

Figure 12:
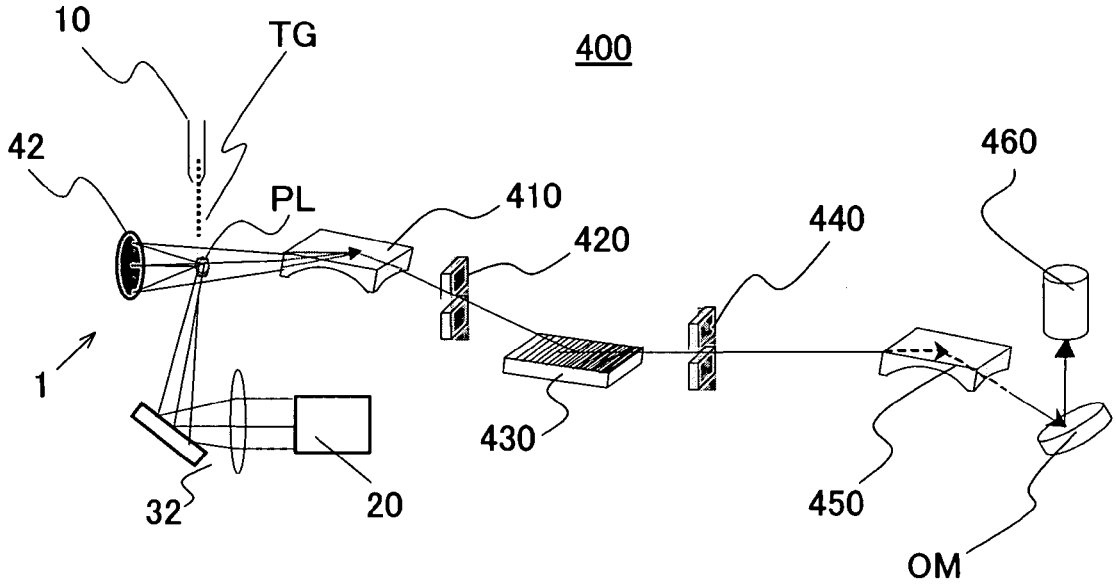
FIG. 12 is a schematic perspective view of a measuring apparatus as one aspect according to the present invention.

Moreover, the light source apparatus 1 can be applied also to the measuring apparatus 400 that measures a reflectivity of an object to be measured OM as shown in FIG. 12. FIG. 12 is a schematic perspective view of the measuring apparatus 400 as one aspect according to the present invention. The measuring apparatus 400 includes a pre-position mirror 410, a slit 420, a diffraction grating 430, a slit 440, a post-position mirror 450, and a detector 460.

Referring to FIG. 12, the measuring apparatus 400 condenses and reflects the laser light LL generated at the laser light source part 20 by the laser optical system 32, and generates the EUV light EL by irradiating it to the target TG supplied from the target supply apparatus 10. The EUV light EL is condensed by the condenser mirror 42, passes through the pre-position mirror 410 and slit 420, is dispersed by the diffraction grating 430, is selected only the desired wavelength by the slit 440, reflects by the post-position mirror 450, is irradiated to the object to be measured OM, and detects the size of the reflection light from the object to be measured OM by the detector 460. The measuring apparatus 400 can measure reflectivity in high accuracy by using the light source apparatus 1.

Furthermore, the present invention is not limited to these preferred embodiments and various variations and modifications may be made without departing from the scope of the present invention.

The present invention provides a light source apparatus and exposure apparatus having the same that irradiates laser to a best position for a target, and maintains a condenser point position of generated light to a predetermined position, and enables an exposure apparatus that has an excellent exposure performance to be achieved.

This application claims a foreign priority benefit based on Japanese Patent Applications No. 2004-123502, filed on Apr. 19, 2004, which is hereby incorporated by reference herein in its entirety as if fully set forth herein.

What is claimed is:

1. A light source apparatus for irradiating a laser light onto a target, for generating plasma, and for producing light from the plasma, said light source apparatus comprising:

a first detection part for detecting a position of the target, an adjusting part for adjusting a position of a condenser point of the laser light; and a first controller for controlling the adjusting part so that the position of the target detected by the first detection part is corresponding to the condenser point of the laser light.

2. A light source apparatus according to claim 1, further comprising:

a second detection part for detecting a position of a condenser point of the light from the plasma, a changing part for changing the position of the condenser point of the light form the plasma; and a second controller for controlling the changing part so that the position of the condenser point of the light detected by the second detection part is within the predetermined range.

3. A light source apparatus according to claim 2, wherein said first controller and second controller are same.

4. A light source apparatus according to claim 1, wherein said adjusting part includes:

an optical system for condensing the laser light; and a driving mechanism for driving the optical system.

5. A light source apparatus according to claim 1, further comprising:

a condenser mirror for condensing the light from the plasma; and a driving mechanism for a position and posture of the condenser mirror.

6. A light source apparatus for irradiating a laser light onto a target, for generating plasma, and for producing light from the plasma, said light source apparatus comprising:

a part for controlling a position of a condenser point of the laser light that the condenser point of the laser light is irradiated to a predetermined position when a position of the target changes.

7. A light source apparatus for irradiating a laser light onto a target, for generating plasma, and for producing light from the plasma, said light source apparatus comprising:

a part for controlling at least one of a position, posture, and form of a condenser mirror that condenses the light so that a condenser point of the light does not change when a generation position of the light changes by a positional change of the target.

8. A light source apparatus according to claim 1, wherein said target is liquid drops.

9. A light source apparatus according to claim 1, wherein said light has a wavelength of 20 nm or smaller.

10. A light generator method for irradiating a laser light onto a target, for generating plasma, and for producing light from the plasma, said light generator method comprising the steps of:

obtaining a position of the target, calculating a driving amount of an optical system that adjusts a condenser point of the light so that the laser light condenses in the position of the target obtained in the obtaining step; and driving the optical system according to the driving amount calculated in the calculating step.

11. A light generator method for irradiating a laser light onto a target, for generating plasma, and for producing light from the plasma, said light generator method comprising the steps of:

obtaining a position of the target, first calculating step for calculating a position of the plasma from the position of the target obtained in the obtaining step, second calculating step for calculating a driving amount of a condenser mirror that changes a position of a condenser point of the laser light so that the condenser point of the laser light is a predetermined position based on the position of the plasma calculated in the first calculating step; and driving the condenser mirror according to the driving amount calculated in the second calculating step.

12. An exposure apparatus for exposing a pattern of a reticle onto an object, said exposure apparatus comprising:

a light source apparatus; and an optical system for illuminating the reticle using light taken by said light source apparatus, wherein said light source apparatus for irradiating a laser light onto a target, for generating plasma, and for producing light from the plasma, said light source apparatus includes, a detection part for detecting a position of the target, an adjusting part for adjusting a position of a condenser point of the laser light; and a controller for controlling the adjusting part so that the position of the target detected by the first detection part is corresponding to the condenser point of the laser light.

13. An exposure apparatus for exposing a pattern of a reticle onto an object, said exposure apparatus comprising:

a light source apparatus; and an optical system for illuminating the reticle using light taken by said light source apparatus, wherein said light source apparatus for irradiating a laser light onto a target, for generating plasma, and for producing light from the plasma, said light source apparatus includes, a part for controlling a position of a condenser point of the laser light that the condenser point of the laser light is irradiated to a predetermined position when a position of the target changes.

14. An exposure apparatus for exposing a pattern of a reticle onto an object, said exposure apparatus comprising:

a light source apparatus; and an optical system for illuminating the reticle using light taken by said light source apparatus, wherein said light source apparatus for irradiating a laser light onto a target, for generating plasma, and for producing light from the plasma, said light source apparatus includes, a part for controlling at least one of a position, posture, and form of a condenser mirror that condenses the light so that a condenser point of the light does not change when a generation position of the light changes by a positional change of the target.

15. A device fabrication method comprising the steps of:

exposing an object using an exposure apparatus; and performing a development process for the object exposed, wherein said exposure apparatus for exposing a pattern of a reticle onto the object, said exposure apparatus includes, a light source apparatus; and an optical System for illuminating the reticle using light taken by said light source apparatus, wherein said light source apparatus for irradiating a laser light onto a target, for generating plasma, and for producing light from the plasma, said light source apparatus includes, a detection part for detecting a position of the target, an adjusting part for adjusting a position of a condenser point of the laser light; and a controller for controlling the adjusting part so that the position of the target detected by the first detection part is corresponding to the condenser point of the laser light.

16. A device fabrication method comprising the steps of:

exposing an object using an exposure apparatus; and performing a development process for the object exposed, wherein said exposure apparatus for exposing a pattern of a reticle onto the object, said exposure apparatus includes, a light source apparatus; and an optical system for illuminating the reticle using light taken by said light source apparatus, wherein said light source apparatus for irradiating a laser light onto a target, for generating plasma, and for producing light from the plasma, said light source apparatus includes, a part for controlling a position of a condenser point of the laser light that the condenser point of the laser light is irradiated to a predetermined position when a position of the target changes.

17. A device fabrication method comprising the steps of:

exposing an object using an exposure apparatus; and performing a development process for the object exposed, wherein said exposure apparatus for exposing a pattern of a reticle onto the object, said exposure apparatus includes, a light source apparatus; and an optical system for illuminating the reticle using light taken by said light source apparatus, wherein said light source apparatus for irradiating a laser light onto a target, for generating plasma, and for producing light from the plasma, said light source apparatus includes, a part for controlling at least one of a position, posture, and form of a condenser mirror that condenses the light so that a condenser point of the light does not change when a generation position of the light changes by a positional change of the target.

18. A measuring apparatus for measuring a reflectivity of an object to be measured, said measuring apparatus comprising:

a light source apparatus, a irradiating part for irradiating the light taken by said light source apparatus to the object to be measured; and a detector part for detecting the light reflected from the object to be measured, wherein said light source apparatus for irradiating a laser light onto a target, for generating plasma, and for producing light from the plasma, said light source apparatus includes, a detection part for detecting a position of the target, an adjusting part for adjusting a position of a condenser point of the laser light; and a controller for controlling the adjusting part so that the position of the target detected by the first detection part is corresponding to the condenser point of the laser light.

* * * * *